United States Patent [19]

Piano

[11] Patent Number: 4,993,211

[45] Date of Patent: Feb. 19, 1991

[54] SOFT CHEWING GUM WRAPPING MACHINE AND METHOD

[75] Inventor: Anthony P. Piano, Sparta, N.J.

[73] Assignee: Warner-Lambert Company, Morris Plains, N.J.

[21] Appl. No.: 435,143

[22] Filed: Nov. 13, 1989

[51] Int. Cl.[5] ..... B65B 11/28; B65B 47/06; B26D 7/06

[52] U.S. Cl. ..... 53/435; 53/464; 53/513; 53/579; 83/154; 83/337

[58] Field of Search ..... 53/435, 453, 464, 513, 53/514, 516, 519, 520, 559, 579; 83/152, 154, 337

[56] References Cited

U.S. PATENT DOCUMENTS

| | | | |
|---|---|---|---|
| 1,659,143 | 2/1928 | Hopkins | 53/516 X |
| 2,653,430 | 9/1953 | Vogt | 53/464 |
| 2,664,833 | 1/1954 | Armstrong et al. | 53/516 X |
| 2,984,138 | 5/1961 | Vitense et al. | 83/337 X |
| 3,273,300 | 9/1966 | Watrous et al. | 53/435 |
| 4,358,920 | 11/1982 | Kanai et al. | 53/516 |
| 4,630,426 | 12/1986 | Gentry | 53/516 X |
| 4,872,382 | 10/1989 | Benner, Jr. et al. | 83/152 |
| 4,875,326 | 10/1989 | Piano | 53/513 |

*Primary Examiner*—Robert L. Spruill
*Assistant Examiner*—Beth Bianca
*Attorney, Agent, or Firm*—Craig M. Bell; Richard S. Bullitt

[57] ABSTRACT

A high speed apparatus for cutting and wrapping soft chewing gum comprises a plurality of substantially parallel cutters having cutting heads to cut the gum into relatively thin rectangular-shaped pieces. The cutters are moved to a position where each individually shaped piece of gum is placed into a nest on a wrapping tray with a wrapper located therebetween. The cutters are moved in an eccentric ovoid path by a ring wheel and grooved cam wheel arrangement which causes the cutting heads to separate and move back together as they move through a cycle. During placement of the stick of gum in the nest, a flat side of the shaped piece of gum is urged against the flat bottom of the nest. The apparatus further comprises an apparatus to complete wrapping the wrapper around the piece of gum.

18 Claims, 5 Drawing Sheets

SOFT CHEWING GUM WRAPPING MACHINE AND METHOD

BACKGROUND OF THE INVENTION

This invention relates generally to machines for wrapping articles. More particularly, this invention relates to a machine for cutting and wrapping soft or uncured gum. The present invention is particularly, but not exclusively, useful for high speed wrapping of sticks of soft or uncured gum which are rectangular shaped and relatively thin.

DISCUSSION OF THE PRIOR ART

Chewing gums are merchandised in various forms. The more common and popular forms are the "stick" gums, the "pillow" shaped gums and the hard confectionary coated "tablets" and "gum balls." Additionally, novelty chewing gums are marketed in a variety of forms depending upon the perceived desires of the purchasing public. As should be expected, each form of gum presents its own unique packaging problems.

While the confectionary coated gums are typically boxed or bagged in bulk, the nature of "stick" gums and "pillow" shaped gums require they be individually wrapped.

If the gum is cured before wrapping, it develops some rigidity which helps in the wrapping process. Indeed, the wrapping of cured "stick" gum is typically accomplished by exploiting the rigidity of cured gum to effectively use the "stick" as a die. More specifically, in this process the edge of a cured, and therefore rigid, piece of "stick" gum is urged against wrapping paper to fold the wrapping paper around the gum. This works fine if the gum is rigid. On the other hand, if the gum is soft or uncured the gum is inherently floppy and cannot be used as a die. As between the "stick" gums and the "pillow" shaped gums, the latter are relatively bulky and, consequently, more rigid. Thus, even when the gum is soft, the "pillow" shaped gums can be fairly easily wrapped. This is not so for "stick" gums. Accordingly, the manufacturing of soft gums has been limited generally to the "pillow" form which, as previously implied, presents a more rigid configuration than the "stick" form.

In addition to the problem of actually wrapping a stick of soft gum, there is also the difficulty of transporting the soft gum through the machine during the wrapping process. Because of the floppy nature of a stick of soft gum, there is a need for continuous support during the wrapping process. Using machines which were designed for wrapping sticks of cured gum has several shortcomings if they are used to wrap sticks of soft gum. Specifically, they neither present the sticks of gum for wrapping, nor transport them through the wrapping machine in a manner which is compatible with the limp and floppy nature of soft gum.

A commercially effective solution to these problems is needed because there is a perceived consumer demand for soft "stick" gum. The configuration of "stick" gum is convenient and the appeal of soft gum is well established.

The present invention recognizes that soft gum can be cut into "sticks" and properly supported during the wrapping process. Specifically, the present invention recognizes that a stick of soft gum can be held and oriented by a machine in a manner which will obviate the difficulties presented by the flaccid nature of uncured soft gum.

The present invention further recognizes that soft gum can be cut and wrapped continuously at a relatively high speed. The present invention further recognizes that this can be accomplished by a continuous rotary method and apparatus.

In light of the above, it is an object of the present invention to provide a gum wrapping machine which will rigidly support a stick of soft gum during the wrapping process. Another object of the present invention is to present a soft stick of gum for wrapping in a manner which will obviate the flaccidity of the gum. Still another object of the present invention is to provide a gum wrapping machine which is cost effective and easy to operate.

SUMMARY OF THE INVENTION

A preferred embodiment of the novel soft chewing gum wrapping machine of the present invention includes a turret for cutting the gum into relatively thin rectangular shaped pieces, i.e. sticks of gum. The turret also conveys these shaped pieces to a position where they can be individually placed into nests on a wrapping tray. More specifically, the turret comprises a plurality of cutting cavities on its periphery in which the individual "sticks" are held by suction for conveyance to a wrapping position after they have been cut. Rotation of the turret cuts sticks of gum from a slab of gum and takes each stick of gum to the wrapping position where it is released from the turret and urged into a nest on the wrapping tray. A wrapper, of foil or waxed paper, is positioned over each nest so that when the gum "stick" is urged into the nest, the wrapper is located therebetween for initiation of the wrapping process. Imporatantly, as the "stick" is urged into the nest, a flat side, not an edge, of the gum "stick" is presented to the nest.

In an alternate embodiment of the present invention, a reversing turret is incorporated between the turret and the wrapping tray. With this alternate embodiment, each stick of gum is transferred to the reversing turret before being urged into a particular nest on the wrapping tray. The reversing turret in the alternate embodiment is similar to the turret of the preferred embodiment in that it holds gum "sticks" thereon by suction. Also, its operation is similar to the turret of the preferred embodiment insofar as placement of each gum "stick" into a nest is concerned.

With the reversing turret incorporated, operation of the wrapping machine provides a linear manufacturing process between the turret and the wrapping tray. Without the reversing turret, the manufacturing operation proceeds onto a return line.

In another embodiment of the present invention a cut and place apparatus is provided for cutting sticks of gum from a gum ribbon and then transferring the sticks to a wrapping wheel. Specifically, this cut and place apparatus comprises a stationary cam wheel which is formed with an ovoid-shaped groove, and a rotatable ring wheel which is juxtaposed to the stationary cam wheel. The apparatus also includes a plurality of cutter assemblies which are each held by the ring wheel and operatively moved as the ring wheel is rotated by their structural interaction with the groove on the cam wheel.

For the purposes of this embodiment of the present invention, the ring wheel is an annulus having a central opening and a plurality of bores which are equally spaced from each other and which each extend radially from the opening to the outer periphery of the ring wheel. A separate cutter assembly is associated with each of the bores and comprises a push rod which is reciprocally mounted in the bore. Individual cam followers, disposed substantially perpendicular to a respective push rod, each have one end fixedly attached to the respective push rod and another end positioned in the groove of the stationary cam wheel. Additionally, a cutter is fixedly attached to each push rod with its cutting edges projected radially outwardly in a direction along the push rod.

In the operation of cut and place apparatus, the ring wheel is rotated and the cam wheel is held stationary. Consequently, the push rods are rotated with the ring wheel and the cam followers which extend from the push rods follow along in the groove of the cam wheel. Due to the particular ovoid shape of the groove in the cam wheel, the cam followers cause the push rods to radially reciprocate in the bore of the ring wheel as the ring wheel is rotated. Consequently, the cutters also reciprocate radially with the push rods. With this movement, the cutters cyclically pass between a position wherein they are each immediately adjacent their neighboring cutters (a starting position) and a separated position wherein they are separated from their neighboring cutter.

A rotatable feed wheel carrying a ribbon of soft gum is mounted below the cut and place apparatus so that the cutting heads engage the gum ribbon when the cutting heads are in the starting position. As the cut and place apparatus rotates, each cutting head engages the gum ribbon on the rotating feed wheel to cut a stick of gum from the ribbon. The stick of gum is then held in the cutting head by vacuum or other means, and carrried in the cutting head to the separated position of the ovoid path.

A wrapping wheel is rotatably mounted above the cut and place apparatus. The wrapping wheel has a series of recesses or nests for receiving individual sticks of gum. Individual pieces of wrapping material such as paper or foil are automatically cut and placed into each nest, and held in place by vacuum ports. The wrapping wheel is positioned so that each nest is aligned with each cutting head when the cutting head is at the separated position in its ovoid path.

The wrapping wheel is rotated so that each stick may be seated into each nest against the wrapping paper. As the cutting heads containing sticks of gum become aligned with the nests, the sticks are transferred from the cutting head to the nest by a cam actuated plunger mounted in the rear of the cutting head. Placing the stick of gum into the nest forms the first folds of the stick wrapping operation. A wrapping apparatus is mounted adjacent the wrapping wheel. Rotation of the wrapping wheel then causes the stick wrapper to engage the wrapping apparatus which closes the wrapping on the stick of gum. After the stick of gum has been transferred from the cutter head, the now empty cutter head continues moving along its ovoid path from the separated position back to its starting position to cut another stick of gum from the gum ribbon.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENTS OF THE PRESENT INVENTION

Figure 1:
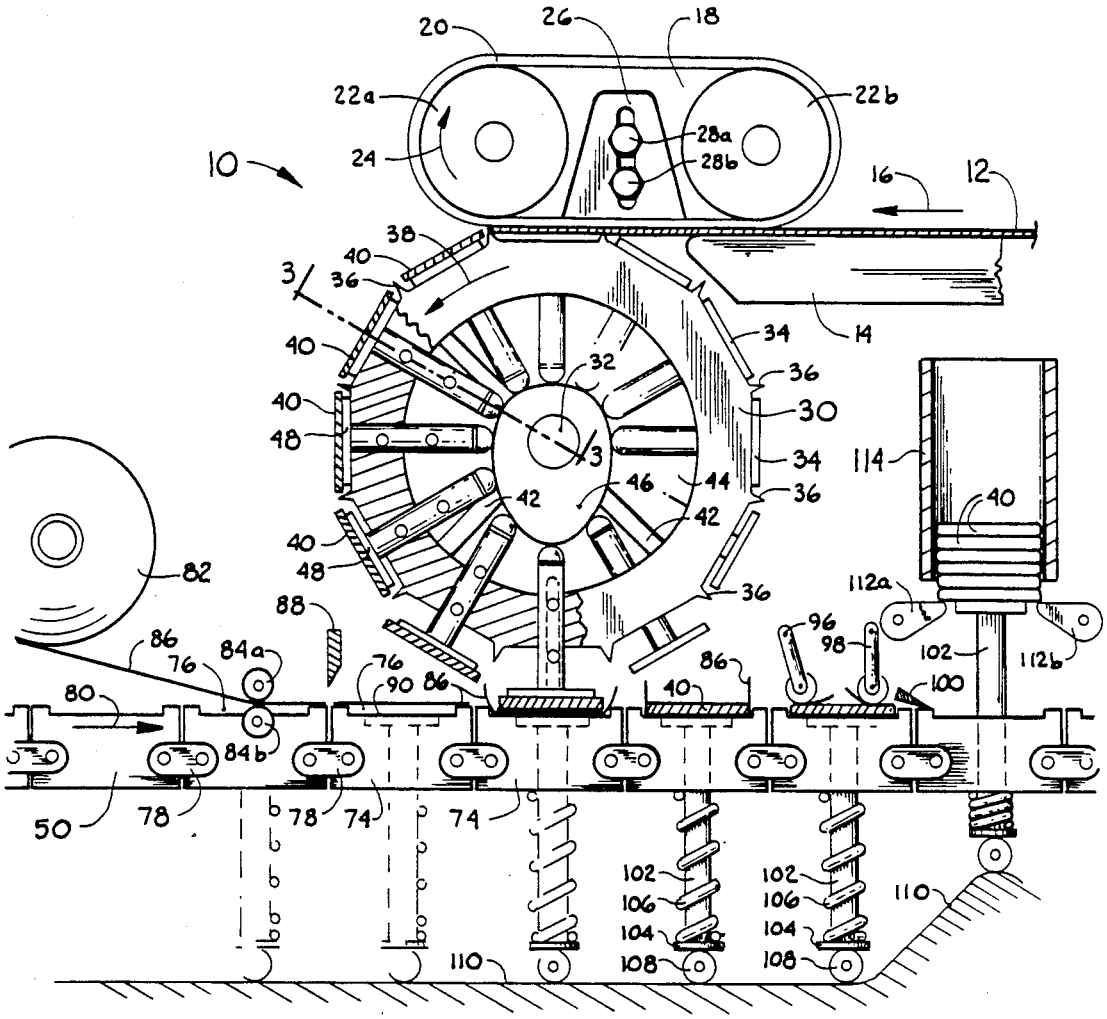
FIG. 1 is a schematic of the preferred embodiment of the present invention.

Referring initially to FIG. 1, the preferred embodiment of the novel soft chewing gum wrapping machine is shown and generally designated 10. As shown in FIG. 1, an extruded, sized slab 12 of chewing gum is fed into machine 10 by a conveyor 14 in the direction indicated by arrow 16. Although slab 12 may be dimensioned in length and width as desired by the operator, typically, slab 12 is dimensioned in its thickness to conform with market expectations for "stick" gum.

The feeding of gum slab 12 into machine 10 is facilitated by feed and pressure assembly 18 which includes a belt 20 that is operatively engaged with drive rollers **22*a* and 22*b*. Rotation of drive rollers 22*a* and 22*b* in the direction indicated by arrow 24 causes belt 20 to draw slab 12 toward machine 10 in the direction of arrow 16. Assembly 18 also includes an adjustable pressure block 26 which, in accordance with the tightened location of bolts 28*a* and 28*b* on block 26, puts pressure on belt 20 to urge slab 12 against turret 30**.

As can be appreciated by reference to FIG. 1, turret 30 is a generally cylindrical shaped body which is operatively connected with a drive motor (not shown) for rotation about the axis of a drive shaft 32. On the surface of turret 30 are located a plurality of cutting cavities 34 which are separated from each other by a series of knives 36 that project radially outward from the surface of turret 30. In accordance with the present invention, rotation of turret 30 about drive shaft 32 in the direction of arrow 38 brings knives 36 into cutting contact with slab 12 to divide slab 12 into individual gum sticks 40.

Still referring to FIG. 1, it will be seen that turret 30 is structurally separated from drive shaft 32 by a series of braces 42 to form a vacuum chamber 44 therebetween. For the purposes of the present invention, any means well known in the art may be used in cooperation with chamber 44 to create a partial vacuum therein. Also, it is seen that a stationary cam 46 is operably mounted in association with chamber 44 for a purpose to be subsequently disclosed. For each cutting cavity 34, a stick holder 48 is provided which functions in cooperation with turret 30, cam 46 and the operation of vacuum chamber 44 to carry gum sticks 40 from a cutting position associated with assembly 18 to a wrapping position associated with wrapping tray 50.

Figure 2:
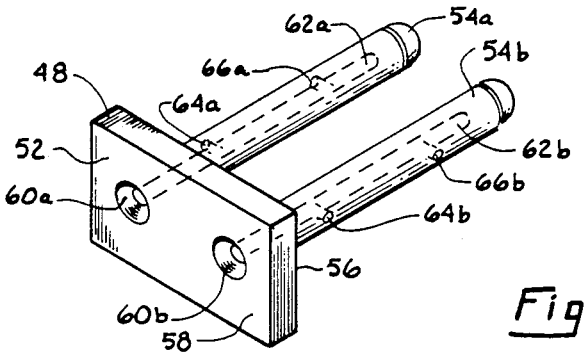
FIG. 2 is a perspective view of the stick holder of the present invention.

The structure for stick holder 48 will perhaps be best appreciated by reference to FIG. 2 in which it can be seen that holder 48 comprises a base 52 having a pair of stems 54*a* and 54*b* extending from the rear side 56 of base 52. The front side 58 of stick holder 48 is formed with a pair of recesses 60*a* and 60*b* which are operative extensions of respective air channels 62*a* and 62*b*. As shown in FIG. 2, air channels 62*a* and 62*b* respectively extend internally along the longitudinal axes of stems 54*a* and 54*b*. Also shown in FIG. 2 are relief ports 64*a* and 64*b* and suction ports 66*a* and 66*b* which are respectively associated in operative communication with air channels 62*a* and 62*b*.

Figure 3A:
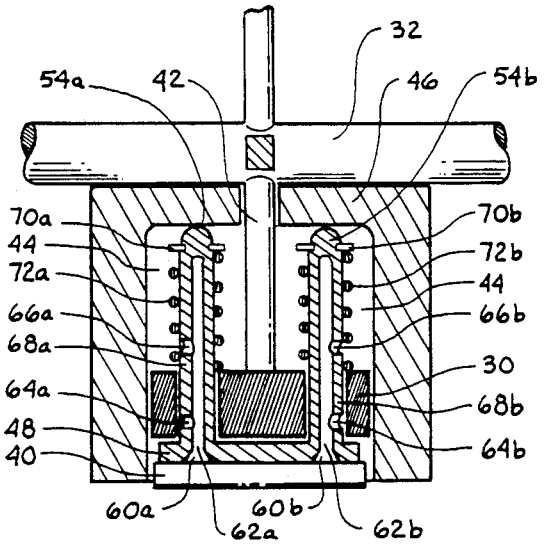
FIG. 3A is a cross-sectional view of part of the present invention as seen along the line 3—3 in FIG. 1 with portions broken away for clarity.
Figure 3B:
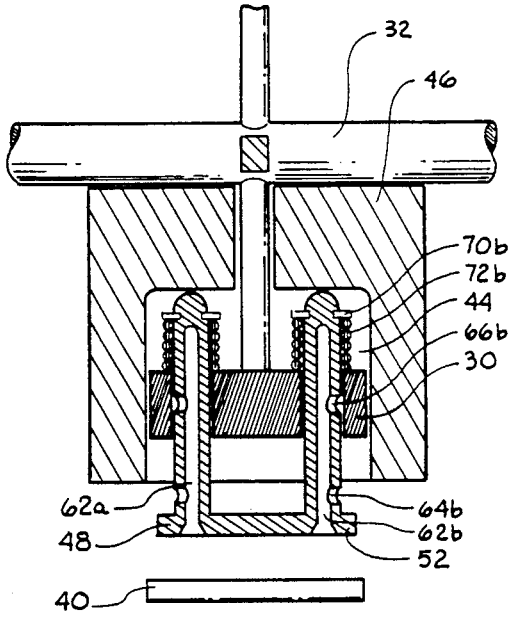
FIG. 3B is a cross-sectional view of the part of the present invention seen in FIG. 3A with component elements in a different configuration.

The cooperation of structure between stick holder 48, turret 30 and cam 46 will be best appreciated by referring to FIGS. 3A and 3B. In FIG. 3A, it will be seen that stems 54*a* and 54*b* are respectively slidably disposed in bores 68*a* and 68*b* of turret 30. Also, it is to be understood that holder 48 is provided with two stems 54*a* and 54*b*, as shown and disclosed above, to provide stability for holder 48 during operation of machine 10. Further, each stem 54*a* and 54*b* is respectively provided with a retainer ring 70*a* and 70*b*. Springs 72*a* and 72*b* are disposed around stems 54*a* and 54*b* and positioned between turret 30. As so disposed, springs 72*a* and 72*b* are biased to urge stems 54*a* and 54*b* of stick holder 48 against cam 46. Thus, depending on the distance between cam 46 and turret 30, base 52 of holder 48 will either rest against turret 30, as shown in FIG. 3A, or be pushed away from turret 30, as shown in FIG. 3B. As will be appreciated, the actions of springs 72*a* and 72*b* urge stick holder 48 into the position shown in FIG. 3A whenever the distance between cam 46 and turret 30 will permit.

Figure 4:
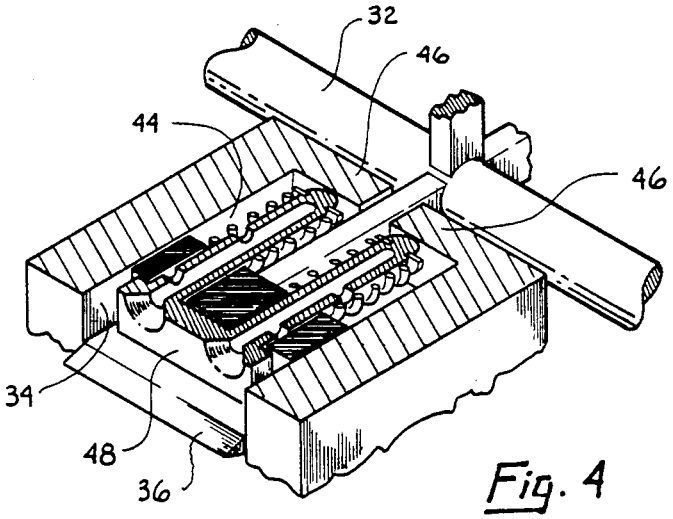
FIG. 4 is a perspective view of the part of the present invention seen in FIG. 3A.

FIG. 4 provides another perspective of the cooperation between holder 48, turret 30 and cam 46. Together with FIGS. 3A and 3B, FIG. 4 shows that holder 48 is intended for reciprocal movement relative to turret 30. As will be more clearly understood subsequently, this reciprocal action is necessary for holding the gum sticks on turret 30 and for the purpose of ejecting gum sticks 40 from cutting cavity 34.

Returning now to FIG. 1, it will be seen that in accordance with the intentions of the present invention, gum sticks 40 are to be held onto holder 48 only until they are presented to wrapping tray 50. The sticks 40 are then released from holder 48. This happens because apparatus (not shown) is used to draw a partial vacuum in chamber 44. Accordingly, when cam 46 permits springs 72*a* and 72*b* to urge holder 48 into the position as shown in FIG. 3A, suction ports 66*a* and 66*b* are in fluid communication with chamber 44. This communication is affected through air channels 62*a* and 62*b* and manifests itself as a sucking action at recesses 60*a* and 60*b* on base 52 of holder 48. The result is that the ambient air pressure forces stick 40 against base 52 to hold the stick 40 on holder 48. It is to be noted that while suction ports 66*a* and 66*b* are in communication with chamber 44, relief ports 64*a* and 64*b* are effectively blocked by turret 30. On the other hand, when cam 46 urges against stems 54*a* and 54*b* to depress springs 72*a* and 72*b*, suction ports 66*a* and 66*b* are effectively blocked by turret 30 and relief ports 64*a* and 64*b* are exposed for direct communication with the ambient air. This negates the sucking action at recesses 60*a* and 60*b* and allows stick 40 to be released from holder 48.

Further reference to FIG. 1 shows that turret 30 is intended to cooperate with operation of wrapping tray 50. As shown, wrapping tray 50 comprises a series of blocks 74 which are each formed with a nest 76. Each block 74 is connected to an adjacent block 74 by means of linked connectors 78 in a manner well known in the pertinent art. As intended for the present invention wrapping tray 50 will function similarly to the well known conveyor belt and progress in a direction relative to turret 30 as indicated by arrow 80.

Figure 6:
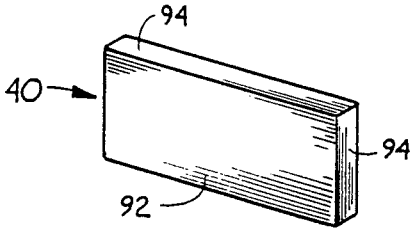
FIG. 6 is a perspective view of a stick of gum.

Disposed in operative relationship to wrapping tray 50 is a roll 82 of wrapping paper 86. It is to be understood that several wrapping materials 86 may be used within the spirit of the present invention. For example, roll 82 may be of waxed paper or foil. Regardless, drive rollers 84*a* and 84*b* draw wrapping 86 from roll 82 and lay wrapping 86 over nest 76 of block 74. In coordination with the movement of wrapping tray 50, a knife means 88 cuts wrapping 86 into appropriate sized sections. Subsequently, when nest 76 is properly positioned with respect to turret 30, a holder 48 urges a stick 40 into the nest 76. Importantly, each nest 76 has a flat bottom 90. Further, and equally as important, a flat side 92 of gum stick 40 is urged into nest 76. At this point, cross reference between FIG. 1 and FIG. 6 will show that presenting a flat side 92 of stick 40 for insertion into nest 76, rather than using an edge 94 of stick 40, greatly obviates any required rigidity for stick 40. Stated differently, the rigidity of stick 40 is rendered essentially immaterial.

Further reference to FIG. 1 shows that as gum stick 40 is inserted into nest 76, wrapping 86 is caused to fold up around edges 94 of stick 40. Also, it can be seen that a back flap kicker 96 and a front flap kicker 98, as well as a plow 100, are each operatively associated with wrapping tray 50 to complete the wrapping process. For purposes of the present invention any back flap kicker 96, front flap kicker 98 and plow 100, well known in the art, can be used.

FIG. 1 also shows that an extracting rod 102 is associated with each block 74. More specifically, each extracting rod 102 has an attached retaining ring 104 with a spring 106 disposed around extracting rod 102 and positioned between block 74 and retaining ring 104. A roller 108, or other gliding means, is associated with extracting rod 102 and positioned with respect thereto to ride along a cam surface 110. It will be appreciated that spring 106 urges roller 108 of extracting rod 102 into contact with cam surface 110. Accordingly, the contour of cam surface 110 will be set to appropriately depress spring 106 and cause extracting rod 102 to lift a wrapped stick 40 from nest 76 of wrapping tray 50.

As also seen in FIG. 1, when individually wrapped sticks 40 are lifted from wrapping tray 50 by the action of extracting rod 102, each stick 40 is pushed against spring loaded retainers 112*a* and 112*b* which yield to the passage of sticks 40. As will be appreciated by the skilled artisan, once sticks 40 have passed retainers 112*a* and 112*b* the sticks 40 will be held in magazine 114 until a predetermined number of sticks 40 have been collected for subsequent bundling.

Figure 5:
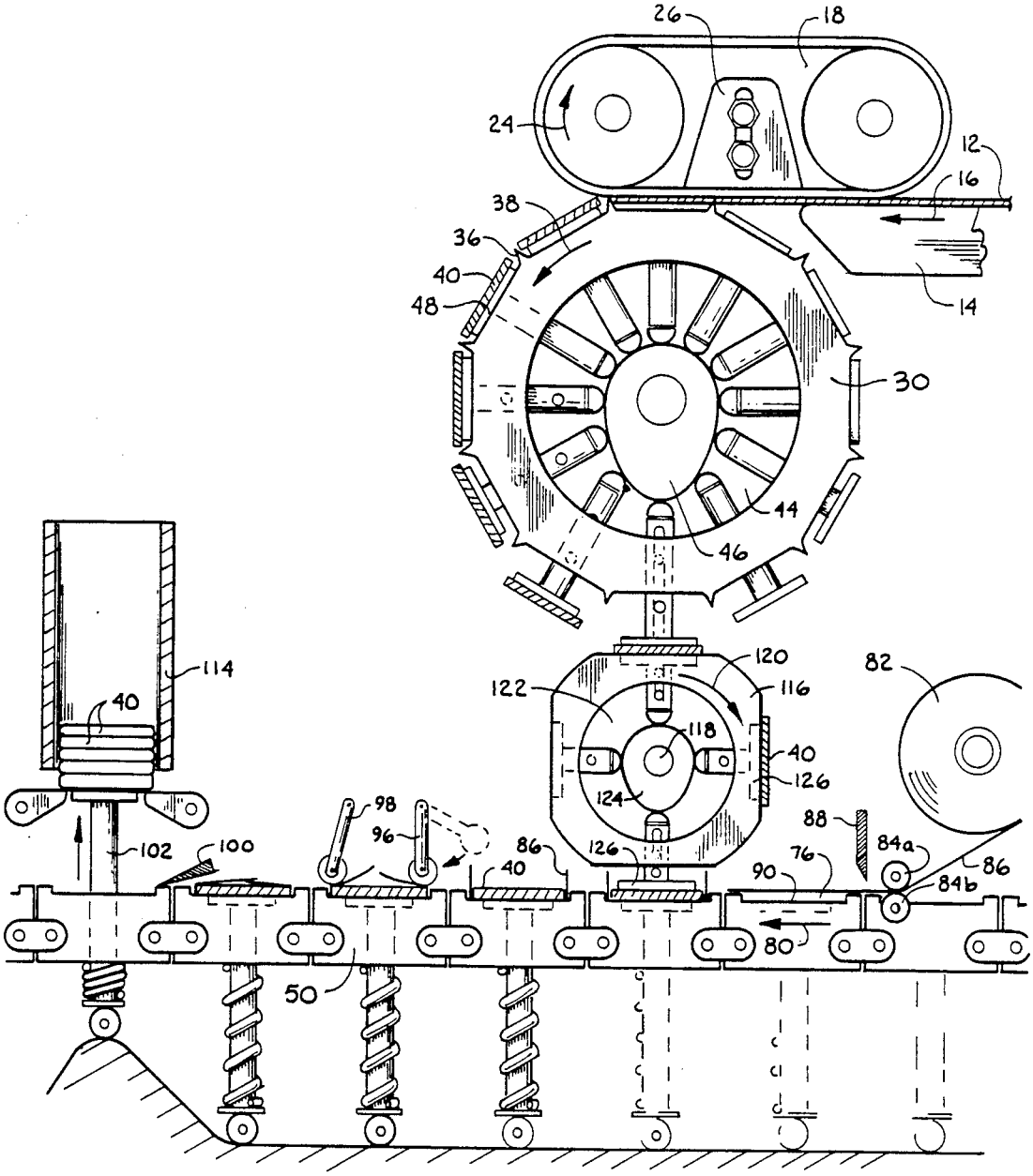
FIG. 5 is a schematic of an alternate embodiment of the present invention.

An alternate embodiment for the present invention is shown in FIG. 5. Specifically, the alternate embodiment is functionally preferable when it is desired to conduct the wrapping operation to be accomplished by machine 10 along a linear assembly line. In other words, the progress of the operation is conducted along a line of operations rather than requiring the doubling back which happens in the operation of the preferred embodiment discussed previously.

In all important respects, the alternate embodiment of the present invention functions substantially in accordance with the disclosure for the preferred embodiment. The difference between the two being essentially the incorporation of a reversing turret 116 for the alternate embodiment. Here also, however, the similarities are substantial. Specifically, reversing turret 116 is driven by a motor (not shown) to rotate about the axis of drive shaft 118 in the direction of arrow 120. Reversing turret 116 is associated with a vacuum chamber 122 and a stationary cam 124 which are substantially similar to the comparable structure associated with turret 30. Further, reversing turret 116 cooperates with a series of stick holders 126 which are similar in structure and cooperation of structure to that disclosed previously for stick holder 48.

As mentioned previously, the cooperation of structure between reversing turret 116, stationary cam 124 and stick holder 126 is similar in all important respects to comparable structure disclosed for the preferred embodiment. However, because turret 30 rotates counter to the rotation of reversing turret 116, a stick 40 ca be passed from conveyor 14 to wrapping tray 50 without a resultant reversing direction in the process.

Figure 7:
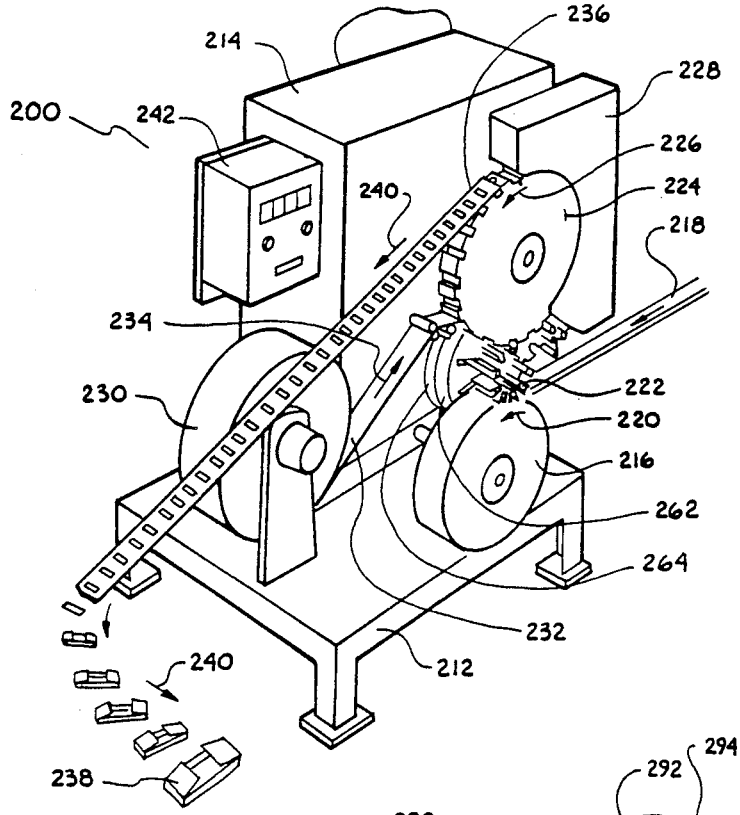
FIG. 7 is a perspective view of an embodiment of a high speed gum wrapping machine incorporating a rotary mechanism in accordance with the present invention.

Referring now to FIGS. 7–10, there is shown yet another embodiment of the present invention incorporating a high speed cutting and wrapping configuration. In particular, there is shown in FIG. 7 a high speed gum wrapping machine 200 as used in its intended environment. High speed gum wrapping machine 200 includes a base 212 on which is mounted a drive mechanism 214, which provides power for driving the working components of the wrapping machine 200. Wrapping machine 200 also comprises a feed wheel 216 which is rotatably coupled to drive mechanism 214. A ribbon of soft gum 218 is fed onto feed wheel 216 in continuous supply fashion, with feed wheel 216 rotating in the counterclockwise direction as shown by arrow 220. Also, rotatably mounted on drive mechanism 214 is a cut and place apparatus 222, which is positioned above feed wheel 216. Mounted above and in alignment with feed wheel 216 is a wrapping or mating wheel 224. Wrapping wheel 224 is rotatably driven by drive mechanism 214, for rotating wrapping wheel 224 in the counterclockwise direction shown generally by arrow 226. Cut and place apparatus 222 is thus interposed between feed wheel 216 and wrapping wheel 224. Mounted adjacent wrapping wheel 224 is a wrapping assembly mechanism 228, which may incorporate a back flap kicker 96, front flap kicker 98, and plow 100 arrangement as shown in FIG. 1. A wrapping paper roll 230 is rotatably mounted on base 212 for feeding wrapping paper, foil, or other wrapping material 232 generally in the direction a indicated by arrow 234. Aligned at the top of wrapping wheel 224 is a chute 236. Chute 236 is adapted to carry individually wrapped sticks of gum 238 generally in the direction indicated by arrow 240, so they may be expelled out the end of chute 236 as generally shown in FIG. 7. A control panel 242 is operably connected to drive mechanism 214 for controlling operation of the high speed gum wrapping machine 200.

Figure 8:
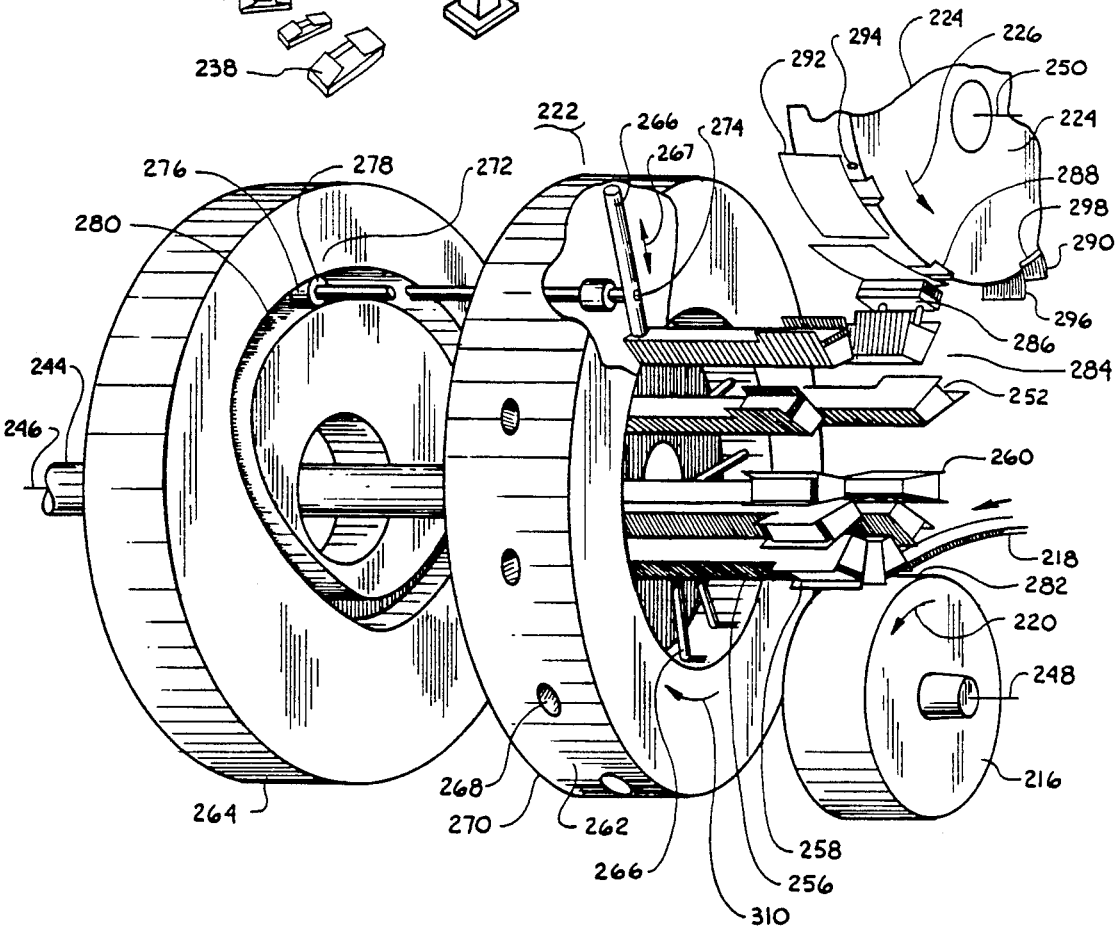
FIG. 8 is a partially exploded perspective view of the rotary mechanism in cooperation with other components of the high speed gum wrapping machine of FIG. 7.

Cut and place apparatus 222 is shown in more detail in conjunction with feed wheel 216 and wrapping wheel 224 in FIG. 8. In particular, cut and place apparatus 222 has a drive shaft 244 oriented substantially along axis 246. Axis 246 is preferably parallel to feed wheel axis 248, and to wrapping wheel axis 250. A rotatable ring wheel 262 is juxtaposed with a stationary slotted or grooved cam wheel 264. In the embodiment shown, ring wheel 262 is mounted coaxially with axis 246. Ring wheel 262 is rotatably driven by shaft 244 but cam wheel 264 is fixed in a stationary position. Cam wheel 264 is formed with an eccentric ovoid or arcuate-shaped groove 280. Ring wheel 262 is an annulus with an open center portion. A plurality of equally spaced radial bores 268 are located in perimeter 270 of ring wheel 262. Bores 268 extend radially from the open center portion to the outer periphery of ring wheel 262.

Disposed within ring wheel 262 are a plurality of cutter assemblies 252. Cutter assemblies 252 are each held in ring wheel 262, and are moved as ring wheel 262 is rotated by their interaction with cam wheel 264. Each cutter assembly 252 is associated with each of the bores 268, and each cutter assembly 252 has a bar support 256, and a cutter head 258. Cutter head 258 has blades 260 which project radially outward for cutting gum sticks 290 from continuous gum ribbon 218. In the embodiment shown, cutter head 258 and blades 260 are generally rectangular-shaped, although other shapes for cutting various shapes of stick gum could be readily accommodated. A series of movable push rods 266 are reciprocally mounted in radial bores 268, and are movable generally in the radial direction shown by arrow 267. Each push rod 266 is rigidly connected to each cutter bar 256 at a substantially right angle to maintain the orientation of each cutter head 258 in a substantially parallel orientation to axis 246. Each push rod 266 is further coupled to a cam groove follower 272. Each cam groove follower 272 has one end 274 connected to push rod 266, and another end 276 on which a roller 278 is rotatably mounted. Roller 278 is positioned to roll within groove 280 of stationary grooved wheel 264. As may readily be appreciated with reference to FIG. 8, groove 280 is a substantially ovoid-shaped groove, which is eccentrically disposed about axis 246.

Figure 10:
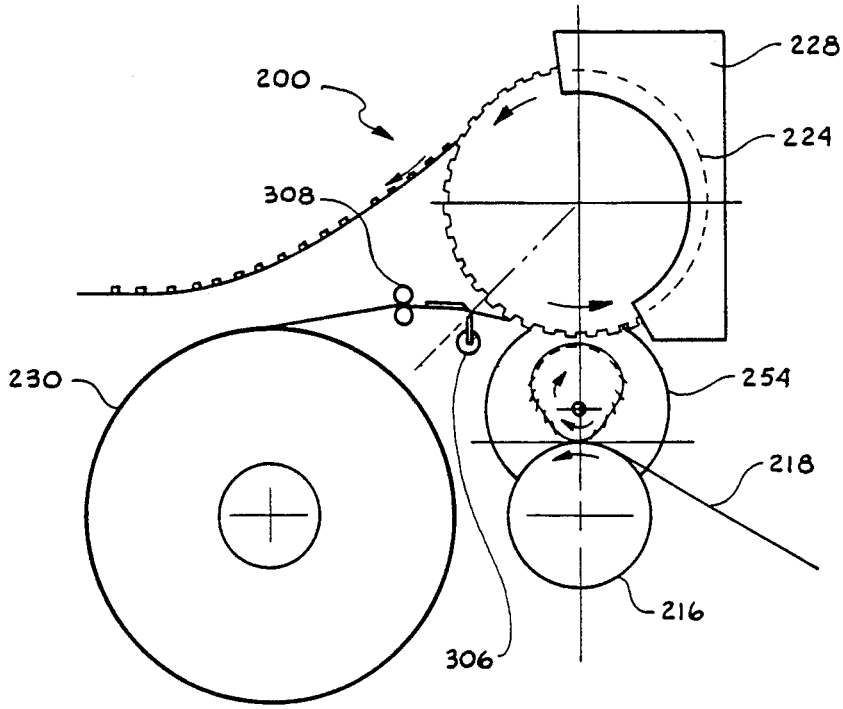
FIG. 10 is a schematic of operation of the high speed gum wrapping machine shown in FIG. 7.

Each cutter assembly 252 is movable about axis 246 between a starting or cutting position 282, and a separated or wrapping position 284. Each cutter head 258 includes an ejecting mechanism 286 which pushes stick of gum 290 out of cutter head 258. A plurality of spaced apart wrapping nests 288 are formed in the periphery of wrapping wheel 224 to receive each stick of gum 290. Ejecting mechanism 286 also includes a vacuum port (not shown) for holding stick gum 290 firmly in cutter head 258 as cutter head 258 is moved in its ovoid path between cutting position 282 and wrapping position 284. Individual wrappers 292, each having a length sufficient to wrap stick gum 290, may be held in place by vacuum ports 294 on wrapping wheel 224. A rotary cutter 306 and paper feed mechanism 308 are mounted adjacent wheel 224 to cut and place appropriately-sized pieces of wrapping paper 292 onto each nest 288, as shown in FIG. 10. Nest 288 in rectangular-shaped s that when stick gum 290 is fully seated in nest 288 by ejecting mechanism 286, edges 296 of wrapper 292, which is disposed between stick gum 290 and bottom of wrapping nest 288, are caused to be deflected outward. When stick gum 290 is thus fully seated in nest 288 as shown at position 298, stick gum 290 is ready for the subsequent wrapping process by wrapping assembly 228 as wrapping wheel 224 rotates in the direction of arrow 226.

OPERATION

In the operation of the novel soft chewing gum wrapping machine 10, a slab 12 of gum is drawn into machine 10 by the action of feed and pressure assembly 18. Pressure caused by block 26 in its action against belt 20 presses slab 12 into the cutting cavities 34 of turret 30 to separate slab 12 into individual sticks of gum 40.

Stick holders 48 are operatively associated with turret 30 to hold sticks 40 onto turret 30 during part of the operation and to subsequently release sticks 40 into wrapping tray 50. The holding function is made possible by stems 54 which project from base 52 and are slidably disposed through turret 30 to extend into vacuum chamber 44. When stems 54*a* and 54*b* are fully extended into vacuum chamber 44, fluid communication is established from chamber 44 through air channels 62*a* and 62*b* to create a sucking action at the recesses 60*a* and 60*b* located on base 52 of stick holder 48. So long as vacuum chamber 44 is in communication with air channels 62*a* and 62*b*, the partial vacuum causes individual sticks 40 to be held within cutting cavities 34. During rotation of turret 30 this action continues until such time as cam 46 urges against the stems 54*a* and 54*b* of stick holder 48 to push stick holder 48 out of the cutting cavity 34. With this action, air channels 62*a* and 62*b* are cut off from fluid communication with the interior of vacuum chamber 44. Instead, relief ports 64*a* and 64*b* establish fluid communication between air channels 62*a* and 62*b* and the ambient air. This association with ambient air negates the suction effect created by vacuum chamber 44 and causes stick 40 to be released from base 52 of stick holder 48.

The operation of stick holder 48 with turret 30 will be further appreciated by cross referencing FIGS. 1, 3A and 3B. With reference to these figures, it will be seen that the connection between drive shaft 32 and turret 30 through braces 42 causes drive shaft 32 to rotate turret 30. Also, stick holder 48 rotates with turret 30 because stems 54*a* and 54*b* of holder 48 slidably extend through bores 68*a* and 68*b* of turret 30 and are retained therein by the interaction of base 52 with springs 72*a* and 72*b*.

Stated somewhat differently from above, as each holder 48 is rotated about the axis of drive shaft 32, stems 54*a* and 54*b* are urged against stationary cam 46 by springs 72*a* and 72*b*. Accordingly, depending on the location of holder 48 relative to cam 46, holder 48 will be urged away from the axis of drive shaft 32 by the action of cam 46 while simultaneously being urged toward the axis of drive shaft 32 by the action of springs 72*a* and 72*b*. The result is a reciprocal motion of holder 48 with respect to turret 30 between a first position and a second position that alternatingly establishes fluid communication either between suction ports 66*a* and 66*b* and vacuum chamber 44 (first position), or between relief ports 64*a* and 64*b* and the ambient air (second position). Also, when holder 48 is in the second position, base 52 is lifted from cutting cavity 34. Consequently, when holder 48 is in the first position, base 52 is seated in cutting cavity 34 and fluid communication between air channels 62*a* and 62*b* and vacuum chamber 44 establishes a sucking action at recesses 60*a* and 60*b* which will hold a stick of gum against base 52. On the other hand, when cam 46 urges holder 48 into the second position, fluid communication between the ambient air and air channels 62*a* and 62*b* stops the sucking action at recesses 60*a* and 60*b* to release stick 40 from base 52.

In accordance with the operation of the present invention, the rotational position of turret 30 must be coordinated with the location of wrapping tray 50. Specifically, as seen in FIG. 1, as a stick holder 48 is urged out of fluid communication with vacuum chamber 44 to release a stick 40 from stick holder 48, the stick holder 48 needs to be positioned with respect to a nest 76 in block 74 of wrapping tray 50 to allow insertion of stick 40 into the nest 76. Additionally, prior to insertion of stick 40 into nest 76, a foil or paper wrapping 86 needs to be positioned across nest 76. This allows the action of inserting stick 40 into the nest 76 to also initiate the wrapping procedure for stick 40. More specifically, as stick 40 is inserted into nest 76, the wrapping 86 is caused to fold over edges 94 of stick 40 in a manner as substantially shown in FIG. 1. Since the position of stick holder 48 in the wrapping position has negated the suction effect from vacuum chamber 44, stick 40 is no longer held by stick holder 48 and upon withdrawal of stick holder 48, will retain in the nest 76.

In accordance with the present invention, once a stick 40 has been properly inserted into nest 76, wrapping tray 50 proceeds in a manner which will present the next nest 76 in line in the position where the next stick 40 can be inserted therein. This action also takes each nest down the manufacturing line to allow the action of back flap kicker 96, front flap kicker 98 and plow 100 to complete the wrapping process of stick 40. Once stick 40 has been completely wrapped, the action of extracting rod 102, in cooperation with cam surface 110, causes each wrapped stick 40 to be lifted from nest 76 and deposited in a magazine 114 for subsequent packaging or bundling procedures.

In the operation of the alternate embodiment of the present invention shown in FIG. 5, all actions are substantially the same as those previously disclosed for the preferred embodiment. As will be appreciated by the skilled artisan the main difference between the preferred embodiment and the alternate embodiment resides in the incorporation of a reversing turret 116 for the alternate embodiment. In all respects, the action of reversing turret 116 is the same as that disclosed for turret 30. More specifically, however, incorporation of reversing turret 116 allows the progress of individual sticks 40, in the transition between conveyor 14 and wrapping tray 50, to remain in the same general direction. This may be preferable in some manufacturing operations, and indeed, may even be essential. In all respects, the action of reversing turret 116 and its cooperation with an associated vacuum chamber 122 and associated stationary cam 124 and comparable stick holders 126 is the same as disclosed for comparable structure of the present invention.

Figure 9:
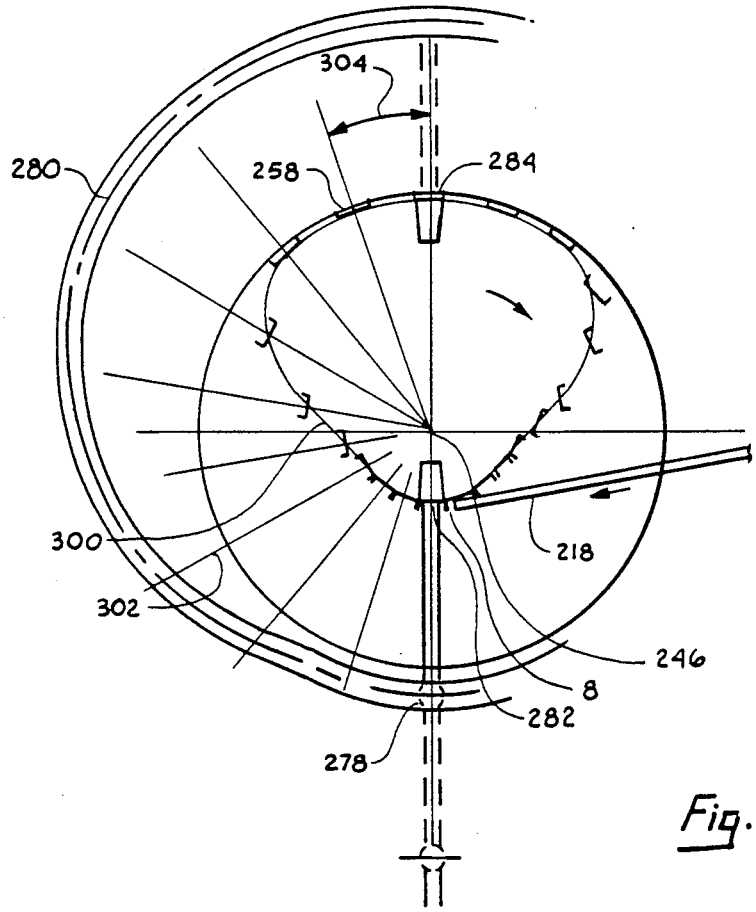
FIG. 9 is a schematic of operation of a series of cutting heads of the rotary, mechanism shown in FIG. 8 in accordance with the present invention.

Operation of the high speed gum wrapping apparatus as disclosed in FIGS. 7 and 8 can perhaps best be appreciated with further reference to FIGS. 9 and 10. There is schematically shown in FIG. 9 the movement of the cutter heads 258 in a substantially arcuate or ovoid-shaped eccentric path 300, as each cutter head 258 cyclically moves between cutting position 282 and wrapping position 284. As earlier mentioned, the movement is caused by roller 278 traveling in groove 280. In particular, it can be appreciated with reference to FIG. 9 that when cutter head 258 is in the cutting position 282, due to the shape of the eccentric arcuate path of groove 280 in fixed cam wheel 264, each of cutting heads 258 are in a position adjacent one another. In this manner, as gum ribbon 218 is cut by cutter heads 258, all of gum ribbon 218 is used, with cuts being made sequentially by blades 260 in gum ribbon 218. Sticks of gum 290 are thus cut and held by vacuum in cutting heads 258. Each cutter head 258 is then cyclically moved in its eccentric ovoid path 300. Due to the radial positioning of push rods 266 about axis 246, each cutting head 258 remains in a position perpendicular to radius line 302 throughout movement of cutting head 258 through one complete cycle along path 300. Due to the eccentric positioning of path 300 about axis 246, cutter heads 258 become separated a predetermined distance apart at wrapping position 284, as shown by arrow 304. Wrapping position 284 is thus 180 degrees from cutting position 282. The amount of separation 304 at position 284 is an amount sufficient to align each cutter head 258 with each nest 288 (not shown in FIG. 9) of wrapping wheel 224.

Further, with reference to FIG. 10, operation of the cut and place apparatus in conjunction with the high speed gum wrapping machine 200 is schematically illustrated further. In particular, gum ribbon 218 is fed from a source onto feed wheel 216. In a preferred embodiment, feed wheel 216 is approximately twelve and three fourths (12.75) inches in diameter, and is rotated at approximately six (6) revolutions per minute. This corresponds to a translational feed rate of as high as two hundred forty (240) inches per minute. Further, in the embodiment shown, cut and place apparatus 222 includes eighteen (18) cutter assemblies 252. Ring wheel 262 of cut and place apparatus 222 may be rotated at twenty-four (24) revolutions per minute, i.e. twenty-four (24) cycles per minute. Wrapping wheel 224 is shown in the embodiment of FIGS. 7–10 as having thirty-six (36) equidistant stations or nests 288 on its periphery. Wrapping wheel 224 has a diameter of approximately seventeen and two tenths (17.2) inches, and is rotated at approximately twelve (12) revolutions per minute.

After the gum is wrapped by wrapping assembly 228, each wrapped stick of gum 290 is carried in each nest 288 until it is released into chute 236. In the embodiment disclosed in FIGS. 7–10, for the dimensions and rotational rates mentioned above, the wrapped gum 238 is released from chute 236 at a rate of approximately five hundred (500) sticks per minute. Wrapped sticks 238 may then be delivered to a final sealing machine (not shown). Thus, it can be seen that the present apparatus allows a high speed wrapping and cutting operation.

While the particular soft chewing gum wrapping machine as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A gum cutting and wrapping machine comprising:

a plurality of cutting heads for cutting sticks of gum from a gum supply;

means coupled to each said cutting head for releasably holding each said stick of gum in said cutting head; and means coupled to said cutting heads for cyclically moving said cutting heads between a cutting position wherein each said cutting head engages said gum supply to cut a stick of gum, and a wrapping position wherein each said cutting head is aligned with a wrapping nest, said cutting heads being disposed adjacent one another when in said cutting position and being separated a predetermined distance when in said wrapping position.

2. A gum cutting and wrapping machine as recited in claim 1, further comprising a cut and place apparatus having a grooved cam wheel fixed in a stationary position and having a substantially ovoid groove eccentrically positioned about an axis, and a cam follower coupled to each cutting head and associated with said groove to move said cutting heads between said cutting position and said wrapping position.

3. A gum cutting and wrapping machine as recited in claim 2, further comprising a ring wheel rotatably mounted about said axis and juxtaposed with said grooved cam wheel, said ring wheel having a periphery with a plurality of radial bores in said periphery, and a push rod reciprocally mounted in each said bore, each said push rod being connected to one of said cutting heads and to one of said cam followers for moving said cutting heads between said cutting and wrapping positions in response to rotation of said ring wheel.

4. A gum cutting and wrapping machine as recited in claim 3, further comprising a wrapping wheel having a periphery with a plurality of wrapping nests formed in said periphery being spaced apart said predetermined distance.

5. A gum cutting and wrapping machine as recited in claim 4, wherein said wrapping wheel includes means for holding individually cut wrappers across each said nest.

6. A gum cutting and wrapping machine as recited in claim 5, wherein said holding means comprises a vacuum line.

7. A gum cutting and wrapping machine as recited in claim 5, further comprising means associated with said wrapping wheel for individually wrapping said sticks of gum placed in said wrapping nest.

8. A gum wrapping machine, comprising:

means for feeding a continuous ribbon of gum;

a plurality of cutting heads for cutting sticks of gum from said ribbon, each said cutting head including means for releasably holding said sticks of gum in said cutting head;

mating means for sequentially receiving sticks of gum into a plurality of wrapping nests being spaced apart a predetermined distance from one another;

means for moving said cutting head in an arcuate path to sequentially align each said cutting head with each said wrapping nest;

means for placing each said stick of gum into each said wrapping nest; and means for wrapping said stick of gum placed in said wrapping nest.

9. A gum wrapping machine as recited in claim 8, further comprising a cut and place apparatus having a grooved cam wheel mounted in a fixed position, said grooved wheel having a substantially ovoid groove eccentrically positioned about an axis, and a cam follower coupled to each said cutting head and associated with said groove to move said cutting heads between said cutting and wrapping positions.

10. A gum wrapping machine as recited in claim 9, further comprising a ring wheel rotatably mounted about said axis and juxtaposed with said grooved cam wheel, said ring wheel having a periphery with a plurality of radial bores in said periphery, and a push rod reciprocally disposed in each said bore, each said push rod being connected to one of said cutting heads and to one of said cam followers for moving said cutting heads between said cutting and wrapping positions in response to rotation of said ring wheel.

11. A gum wrapping machine as recited in claim 10, wherein said mating means comprises a wrapping wheel having a periphery with said plurality of wrapping nests formed in said periphery and being spaced apart said predetermined distance.

12. A gum wrapping machine as recited in claim 11, wherein said wrapping wheel includes means for holding individually cut wrappers across each said nest.

13. A gum wrapping machine as recited in claim 12, wherein said holding means comprises a vacuum line.

14. A method of cutting and wrapping sticks of gum, comprising the steps of:

cutting sticks of gum from a gum supply with a plurality of cutting heads; and sequentially moving said cutting heads in an arcuate path eccentrically about an axis between a cutting position wherein each said cutting head is adjacent a next cutting head to engage said gum supply to cut a stick of gum, and a wrapping position wherein each said cutting head is separated a predetermined distance from said next cutting head.

15. A method of cutting and wrapping sticks of gum as recited in claim 14, further comprising the step of holding said stick of gum in said cutting head after said cutting step.

16. A method of cutting and wrapping sticks of gum as recited in claim 15, further comprising the step of ejecting said stick of gum into a wrapping nest when said cutting head has been moved to said wrapping position.

17. A method of cutting and wrapping sticks of gum as recited in claim 16, further comprising the step of placing a wrapper across said wrapping nest prior to said ejecting step.

18. A method of cutting and wrapping sticks of gum as recited in claim 17, further comprising the step of wrapping said stick of gum after its placement into said wrapper covered wrapping nest.

* * * * *